US007380352B2

(12) United States Patent
Seiter

(10) Patent No.: US 7,380,352 B2
(45) Date of Patent: Jun. 3, 2008

(54) SHOE INSOLE FOR DIABETICS

(76) Inventor: Hans Seiter, Wilhelmsplatz 11, 70182 Stuttgart (DE)

( * ) Notice: Subject to any disclaimer, the term of this patent is extended or adjusted under 35 U.S.C. 154(b) by 292 days.

(21) Appl. No.: 10/511,435

(22) PCT Filed: Apr. 10, 2003

(86) PCT No.: PCT/EP03/03705

§ 371 (c)(1),
(2), (4) Date: Oct. 25, 2004

(87) PCT Pub. No.: WO03/090573

PCT Pub. Date: Nov. 6, 2003

(65) Prior Publication Data

US 2005/0166425 A1 Aug. 4, 2005

(30) Foreign Application Priority Data

Apr. 24, 2002 (DE) ..... 102 18 987

(51) Int. Cl.
*A43B 13/38* (2006.01)

(52) U.S. Cl. ..... 36/44; 36/28

(58) Field of Classification Search ..... 36/43, 36/44, 141, 140

See application file for complete search history.

(56) References Cited

U.S. PATENT DOCUMENTS 492,994 A 3/1893 Sawyer (Continued)

FOREIGN PATENT DOCUMENTS

DE 3306425 A1 8/1984

(Continued)

OTHER PUBLICATIONS

Patent Abstracts of Japan—06054702.

*Primary Examiner*—Ted Kavanaugh
(74) *Attorney, Agent, or Firm*—Bacon & Thomas, PLLC

(57) ABSTRACT

A shoe insole (111) for diabetics is provided with a sole base body (136), a sole covering layer (137) and with a number of cushion-like layers (112, 113, 114, 115, 116) distributed over the surface of the sole. The cushion-like layers consist of at least one first cushion-like layer (112) in the forefoot joint area, a second cushion-like layer (113) in the midfoot/tarsus transition area, and of a third cushion-like layer (114) in the midfoot/heal transition area. These cushion-like layers serving to assist venous blood draining are each subdivided into individual plateau-like areas (118 to 127) that are adjacent in the transversal direction of the sole surface (117) while being separated from one another. The top side of the cushion-like layers also covered by the sole covering layer (137) is raised relative to the level of the top side of the sole base body (136). The aim of the invention is to provide a shoe insole of the aforementioned type that, while providing a lasting assistance of arterial inflow into the foot or foot sole area, has a continuing positive influence on the foot or foot sole areas endangered by a diabetic metabolic condition. To this end, at least one indentation (161, 162) is provided between the first cushion-like layer (112) in the forefoot joint area and the second cushion-like layer (113) in the midfoot/tarsus transition area. Said indentation serves to relieve the pressure on the midfoot bone capitulum(s) and emanates from the top side of the sole base body (136).

13 Claims, 3 Drawing Sheets

U.S. PATENT DOCUMENTS

| | | | | | |
|---|---|---|---|---|---|
| 6,000,147 | A | | 3/1893 | Kellerman | |
| 1,093,608 | A | | 4/1914 | Delaney | |
| 1,730,466 | A | | 10/1929 | Mallot | |
| 1,841,942 | A | | 1/1932 | Fenton | |
| 1,867,431 | A | | 7/1932 | Wood | |
| 1,907,136 | A | | 5/1933 | Weitsen | |
| 1,960,418 | A | | 5/1934 | Schaller | |
| 2,404,731 | A | | 7/1946 | Johnson | |
| 2,423,622 | A | | 7/1947 | Samblanet | |
| 2,502,774 | A | | 4/1950 | Ailaniello | |
| 2,734,287 | A | | 2/1956 | Maccarone | |
| 3,922,801 | A | | 12/1975 | Zente | |
| 4,020,570 | A | | 5/1977 | Shames | |
| 4,079,526 | A | | 3/1978 | Fukuoka | |
| 4,408,402 | A | | 10/1983 | Looney | |
| 4,633,877 | A | | 1/1987 | Pendergast | |
| 4,694,831 | A | | 9/1987 | Seltzer | 128/582 |
| 4,760,655 | A | | 8/1988 | Mauch | |
| 4,793,078 | A | * | 12/1988 | Andrews | 36/43 |
| 5,167,999 | A | | 12/1992 | Wang | |
| 5,179,792 | A | | 1/1993 | Brantingham | |
| 5,509,218 | A | | 4/1996 | Arcan et al. | 36/43 |
| 5,761,834 | A | | 6/1998 | Grim et al. | 36/88 |
| 5,768,803 | A | | 6/1998 | Levy | 36/43 |
| 5,787,608 | A | | 8/1998 | Greenawalt | |
| 5,864,969 | A | | 2/1999 | Mauch | |
| 5,979,086 | A | | 11/1999 | Vindriis | 36/153 |
| 2001/0039746 | A1 | * | 11/2001 | Seiter | 36/44 |

FOREIGN PATENT DOCUMENTS

| | | |
|---|---|---|
| DE | 8431831 | 2/1985 |
| DE | 3508582 C2 | 2/1987 |
| DE | 8700681.2 | 4/1987 |
| DE | 9002962.3 | 6/1990 |
| DE | 9013727.2 | 12/1990 |
| DE | 19603755 | 8/1997 |
| DE | 3527938 | 2/1998 |
| EP | 0316289 | 5/1989 |
| EP | 0971606 | 5/1998 |
| GB | 2289650 | 11/1995 |
| JP | 06054702 | 1/1994 |
| WO | WO 94/23603 | 10/1994 |

* cited by examiner

SHOE INSOLE FOR DIABETICS

This application is a 371 of PCT/EP03/03705 filed on Apr. 10, 2003.

FIELD OF THE INVENTION

The present invention relates to a shoe insole, embodied as a foot pad.

BACKGROUND OF THE INVENTION

On average, one out of every five persons between the ages of 20 and 70 requires treatment for some venous problem, and even one out of three experiences pathological venous changes that although not yet requiring invasive treatment nevertheless cause problems and can require treatment later on. This is due in general to an often hereditary weakness in connective tissue that causes slackening of the walls of the veins, leading to an inadequate capability of the valves in the veins to close. The result is a reduction in the venous return flow from the legs into the trunk. A shoe insole for such persons is known from European Patent Disclosure EP 0 971 606 B1. By synergistically reinforcing muscular contraction during motion of the ankle joints, such shoe insoles considerably improve the venous return from the foot through the legs into the trunk. Because the cushion-like or cushion layers are not raised in solitary fashion but instead are placed in plateau-like or plateau form in certain areas of the foot and are subdivided in a targeted way into separate fields, suitable abutment areas are created that positively affects contraction of the musculature in the foot. Not only when the foot is in motion, but also to a large extent while the person is standing, these discrete abutment points press mechanically and homogeneously on the venous and lymphatic vascular system because of the inducement and stimulation of muscular contraction, leading to the aforementioned increase in venous return from the legs toward the trunk. This characteristic reinforcing motion promotes the activity of the so-called muscular pump of the foot and calf.

Moreover, in Germany, there are about 5,000,000 diabetic, in whom what is called a "diabetic foot" can occur in a more or less severe form. This means ulcerated wounds on the sole of the forefoot, which can become infected and not infrequently lead to the necessity of amputation of the foot (approximately 25,000 instances per year in Germany). The causes of the diabetic foot are found in the fact that because of the diabetic metabolism situation in the arterial vascular system, constrictions and sometimes closure of major arteries (macroangiopathy) and smaller arteries and capillaries (microangiopathy) occur. As a result, the tissue and in particular the skin is no longer adequately supplied with oxygen and partly breaks down (forming an ulcerated place). Because of the reduced function particularly of the arterial capillaries, the nerves of the skin are no longer adequately nourished, and diabetic polyneuropathy occurs. This means that sensitivity and hence the perception of pain decrease markedly in the patient in the area of skin that is no longer adequately nourished, and hence anatomically dictated pressure points are no longer felt, and the skin can be damaged "painlessly" as a result, leading to an ulcerated place in the skin in this area.

SUMMARY OF THE INVENTION

The object of the present invention is therefore to create a shoe insole of the type defined at the outset which is suitable for diabetics, or in other words while constantly reinforcing the arterial inflow into the region of the foot, or the sole of the foot, also provides more-extensive positive influence on the areas of the foot and sole that are threatened by the diabetic metabolism situation.

For attaining this object, a shoe insole that provides at least one depression between the first cushion-like layer in the forefoot joint area and the second cushion-like layer in the midfoot/tarsus transition area, for relieving the pressure on the head or heads of the metatarsal bone or bones and originating at the top side of the sole base body.

Although the desired starting points for reinforcing arterial inflow on the one hand and the points threatened by the diabetic metabolism on the other initially appear contrary, it is achieved by the provisions of the invention that while the arterial inflow remains improved in a constant way, the points of the foot or sole that are known to be at risk can be relieved in such a way that these threatened points do not become ulcerated, and even such places that are already ulcerated place heal over again within an acceptable length of time. In the first case, pressure points that cause ulceration of those places do not even arise, while in the second case, because of the pressure relief of the anatomically threatened places, these places can heal again; in both cases, the improvement in arterial inflow and hence in capillary circulation also makes a contribution. This pressure relief is due to the fact that because of the depressions, the heads of the metatarsal bones do not rest on the top side of the surface of a sole but instead in a sense float freely. As noted, the discrete abutment area continues to be preserved for improving the speed of venous return; that is, relief of the peripheral veins and venous capillaries occurs, which enhances the arterial inflow of blood and thus means an improvement in circulation and in the supply of oxygen to the tissue. Because of the improved capillary-arterial circulation, there is an improved supply to the sensitive nerves of the skin areas; the sensitivity and hence the perception of pain in the skin areas affected is improved, thus reducing the risk that these skin areas will become ulcerated. All these factors aid in preventing diabetic foot from occurring, and if a diabetic foot exists, they aid in healing it without amputation.

With, a depression provided for the second head of the metatarsal bone, and/or one depression for the third head of the metatarsal bone, it is attained that particularly those areas that are primarily threatened anatomically are relieved. An advantageous disposition of the depressions relative to the cushion-like layer or layers characterized in that the depression for the respective head of the metatarsal bone is located approximately in alignment with the respectively associated plateau-like area of the first cushion-like layer.

An especially advantageous embodiment results from further reinforcement of the so-called floating state of the anatomically threatened places, and thus further pressure relief of them, are attained.

To further reinforce circulation, in the region of the heel, a fourth cushion-like layer is provided, which is plateau-like and preferably homogeneously oval in the transversal position of the sole, and/or in the region of the plantar arch, a fifth cushion-like layer is provided of crescent-like shape, with the cushion-like layers formed by a soft foam.

Further details of the invention can be learned from the ensuing description, in which the invention is described and explained in further detail in terms of the exemplary embodiments shown in the drawing. Shown are:

DESCRIPTION OF THE PREFERRED EMBODIMENTS

Figure 1:
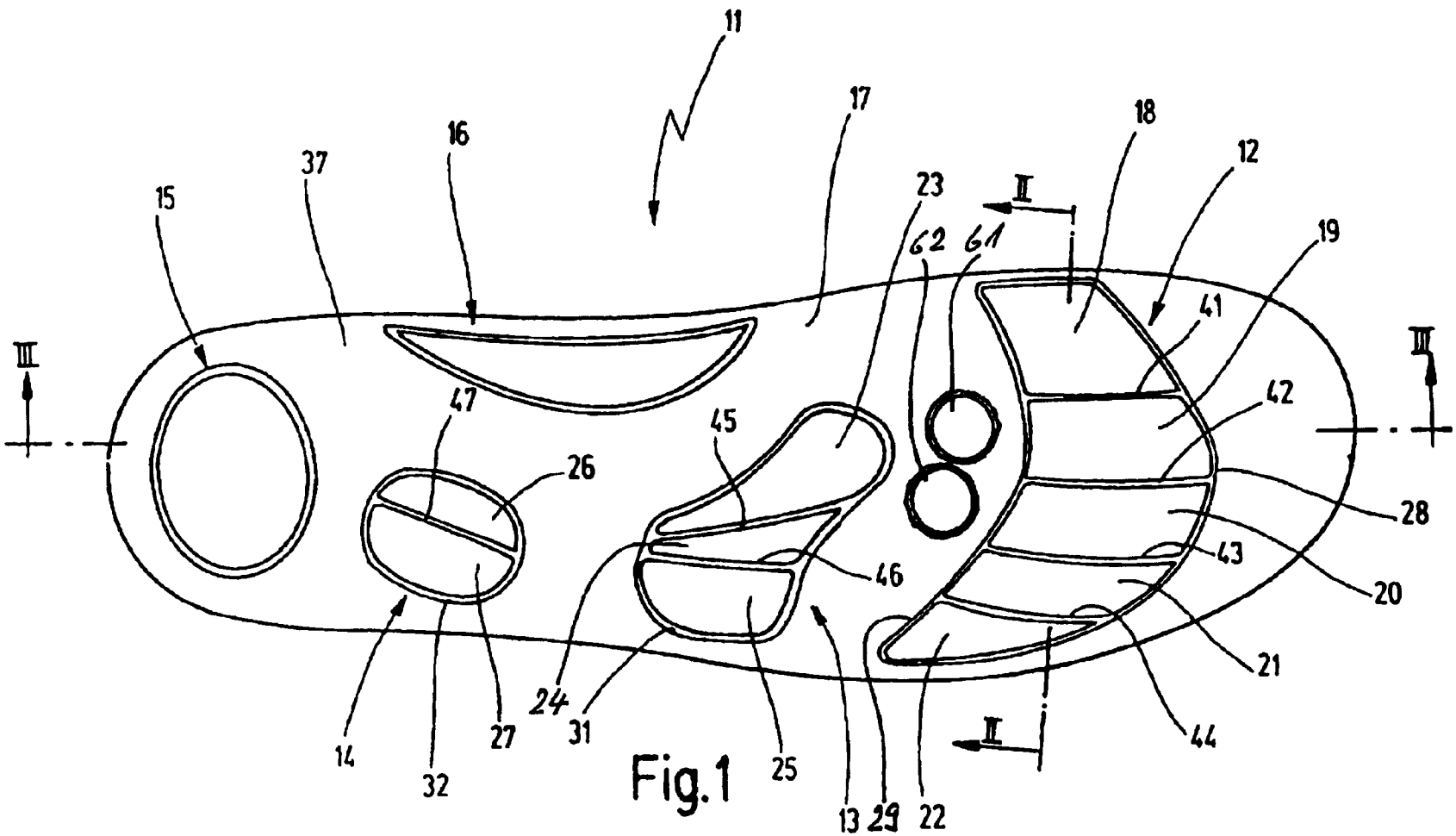
FIG. 1, a plan view on a shoe insole in a first exemplary embodiment of the present invention.

The shoe insole 11 and 111 shown in the drawings and embodied for instance as a pad for a foot, in two exemplary embodiments of the present invention, serves in combination both to synergistically support the musculature when the ankle joints are in motion, to improve arterial inflow into the region of the foot and the sole, and thus to promote circulation in the capillaries, and to mechanically relieve problem areas on the soles of the feet that are due to (poor) diabetic metabolism. It may be embodied as either a separately inserted insole, or as a sole that is integrated with a shoe.

Figures 4, 5, 6:
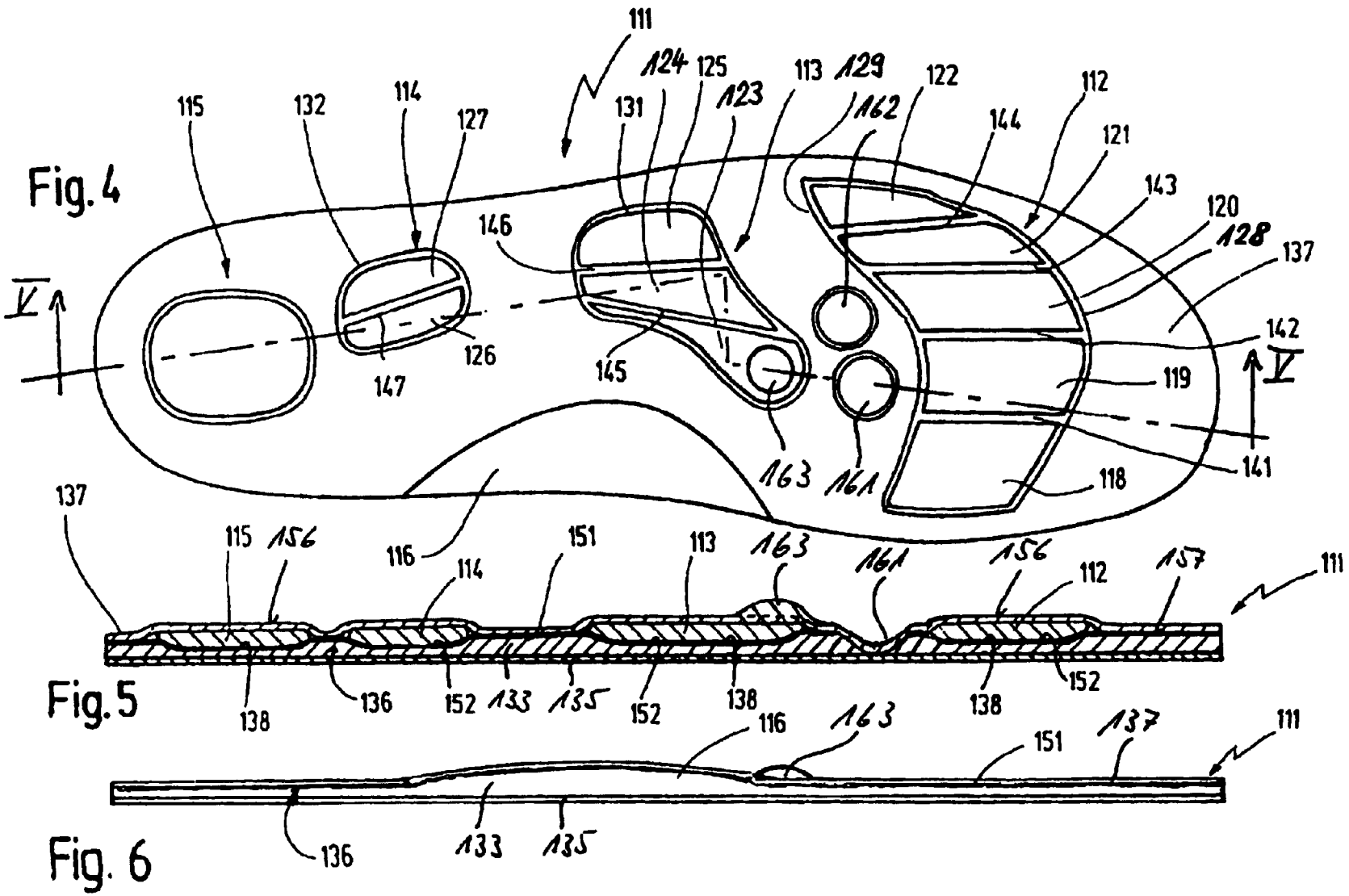
FIG. 4, a plan view on a shoe insole in a second exemplary embodiment of the present invention.
FIG. 5, a section taken along the line V-V in FIG. 4.
FIG. 6, an inside view in the direction of the arrow VI in FIG. 4.

As can be seen from FIGS. 1 and 4, the insole 11 and 111 has a plurality of cushion-like layers 12 through 16 and 112 through 116, respectively, provided over the surface 17 and 117 of the sole, of which the cushion-like layers 12, 112, 13, 113, and 14, 114 are subdivided into individual plateau-like areas 18 through 22, 118 through 122; 23 though 25, 123 through 125; and 26, 27 and 126, 127, which are all separate from each other.

The first cushion-like layer 12, 112 is provided in the forefoot joint area, that is, in the region of the toes. This first cushion-like layer 12, 112 is subdivided into the five areas 18 through 22, 118 through 122 that are separate from one another and are disposed adjacent one another in the transversal direction of the insole 11, 111. The individual areas 18 through 22, 118 through 122 are of different widths and lengths, correspondingly approximately to the outline of the portions of the individual toes. The same is correspondingly true for the shape of the front and rear boundary line 28, 128 and 29, 129, respectively, of this first cushion-like layer 12, 112. The second cushion-like layer 13, 113 is provided in the transition area of the midfoot and tarsus and in an area that is remote from the plantar arch. This second cushion-like layer 13, 113 is subdivided into three fields 23 through 25, 123 through 125, which are shaped to match this portion of the midfoot/tarsus and are subdivided adjacent one another in the transversal direction of the insole 11, 111. The same is correspondingly true for the shape of the circumferential boundary line 31, 131 of this second cushion-like layer 13, 113. The third cushion-like layer 14, 114 is provided in a transition area of the midfoot and heel and is subdivided into the two fields 26, 126 and 27, 127 located adjacent one another in terms of the transversal direction of the insole and laterally on the outer side. Once again, the circumferential boundary line 32, 132 approximately matches the transition area from the midfoot to the heel.

The fourth cushion-like layer 15 and 115 is disposed in the region of the heel and is embodied in plateau-like form as a unitary, non-subdivided layer that is approximately oval in the transversal and longitudinal directions of the insole 11, 111. The fifth cushion-like layer 16, 116 is also embodied as a unitary, non-subdivided layer, but is provided approximately in a crescent shape in the region of the plantar arch.

The cushion-like layers 12 through 16, 112 through 116 are made from an elastic (foam) material, such as a silicone. They have a flat upper surface and are approximately rectangular, and advantageously slightly trapezoidal, in cross section.

Moreover, between the first cushion-like layer 12, 112 in the forefoot joint area and the second cushion-like layer 13, 113 in the midfoot/tarsus transition area, one or more depressions 61, 62 and 161, 162 are provided, serving to relieve pressure on the head or heads of the metatarsal bone or bones. In the exemplary embodiments, the depressions 61, 62 and 161, 162 are disposed in the region of the second and third heads of the metatarsal bones, respectively; it is understood that they may instead be disposed in a different number in combination in the area of the first, second, third, and/or fourth head of the metatarsal bone.

Figure 2:
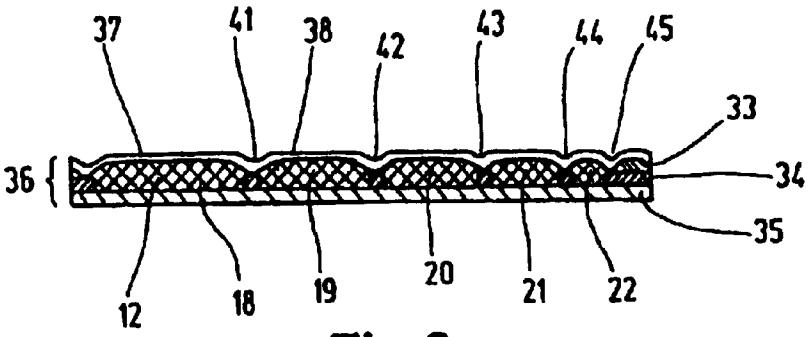
FIG. 2, in an enlarged view, a section taken along the line II-II in FIG. 2.
Figure 3:
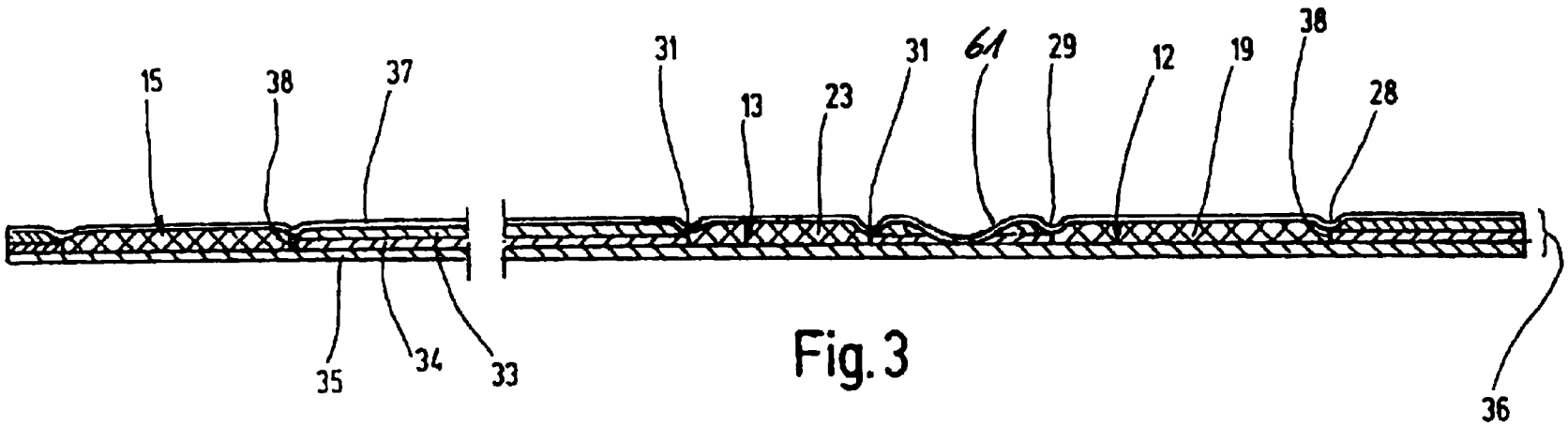
FIG. 3, in an enlarged view, a section taken along the line III-III in FIG. 1.

In the first exemplary embodiment of FIGS. 1 through 3, the insole 11 has what in this case is a three-layered sole base body 36, which forms the basic shape of the insole 11 and is embodied to fit a foot, in this case the right foot, in FIG. 1. It is understood that the corresponding other insole 11, that is, the left one, is mirror-symmetrical to it. The sole base body 36 for instance comprises three layers of cork 33, 34, 35. A sole covering layer 37 is provided on the sole base body 36 and is for instance of leather. Between the sole base body 36 and the sole covering layer 37, the cushion-like layers 12 through 16 are disposed in such a way that they are let into the sole base body 36. To that end, the sole base body 36, in its upper and middle layers 33, 34, is provided with corresponding indentations 38, which have a different outline, corresponding to the fields 18 through 27 of the cushion-like layers 12 through 14 and on the cushion-like layers 15, 16. The indentations 38 are made so deep into the sole base body 36 that the flat top side of the plateau-like cushion-like layers 12 through 15 are each located in approximately the same plane or in other words are coplanar with the surface of the sole base body 36. The cushion-like layer 16 is an exception. In this exemplary embodiment, the indentations 38 extend as far as the top side of the lower layer 35. The cushion-like layers 12 through 15 are each approximately the same height, which is in a range of between 2 and 5 mm, preferably approximately 3 mm. The upper material, that is, the sole covering layer 37, covers the cushion-like layers 12 through 16 such that they, or their fields 18 through 27, are surrounded by indented edges and are solidly joined, preferably glued, to the middle layer 34 of the sole base body 36, so that besides the boundary lines 28, 29 and 31, 32, intermediate boundary lines 41 through 47 are also created that extend approximately perpendicular to the transversal direction of the insole 11. In other words, the indentations 38 are embodied to correspond to the total outline of the cushion-like layers 12 through 15.

In a manner not shown, it is possible for a cushion-like elastic intermediate layer to be provided over the full surface over the sole base body, between the sole base body and the sole covering layer. The intermediate layer is made from the same elastic material as the cushion-like layers 12 through 16 and is solidly joined, preferably glued, to the full surface of one of the layers of the sole base body that have no indentations. The cushion-like intermediate layer may have an approximately uniform thickness in the range from 2 to 3 mm over the entire outline, resulting in a continuous flat cushion which is considerably more elastic than the layers of the sole base body 36, and which may be placed over the entire surface only between the lower layer and the middle layer. The intermediate layer between the middle layer 34 and the upper layer 33 may instead have a varying thickness, so that the upper layer is provided with indentations and the cushion-like intermediate layer is provided with indentations corresponding to the indentations 38, for receiving the cushion-like layers 12 through 16, over which in turn the top material or the sole covering layer extends in the same way as the sole covering layer 37 of FIGS. 2 and 3.

The two depressions 61 and 62, which in use are located under the second and third heads of the metatarsal bones, respectively, begin at the top side of the sole covering layer 37. The depth of the depressions 61, 62 is essentially approximately equivalent to the thickness of the two cork layers 33 and 34 or of the intermediate layer, so that they extend as far as the bottom of the sole base body 36. The base of the depressions 61, 62 is formed by the sole covering layer 37. The two depressions 61 and 62, located adjacent one another in the transversal direction of the shoe insole 11, are in alignment, viewed in the longitudinal direction of the shoe insole 11, with the field 19 and the field 20, respectively, of the first cushion-like layer 12. The two depressions 61 and 62 are located essentially approximately in the middle between the first cushion-like layer 12 and the second cushion-like layer 13.

In the second exemplary embodiment of FIGS. 4 through 6, the insole 111 has a two-layered sole base body 136, which forms the basic shape of the insole 111 and is embodied as shown in FIG. 4 to fit a foot, in this case the left foot. It is understood here as well that the correspondingly other insole, that is, the right one, is embodied mirror-symmetrically. The sole base body 136 is constructed of layers 133, 135, for instance two in number, of cork or elastic plastic, over which a sole covering layer 137 of leather is provided.

Between the sole base body 136 and the sole covering layer 137, the cushion-like layers 112 through 115 are disposed in such a way that they are let into the layer 133 of the sole base body 136. To that end, the sole base body 136 is provided with corresponding indentations 138, which have different outlines to suit the fields 118 through 127 of the cushion-like layers 112 through 114 and to suit the cushion-like layer 115. For instance, the sole base body 136 has a maximum thickness in the range from 3.5 to 4 mm, preferably 3.7 mm, and a minimum thickness in the region of its indentations 138 of between about 1 mm and 1.5 mm, and preferably 1.3 mm. The sole base body 136, which for instance is multi-layered, may be covered with a fine textile overlay over the entire surface of its top. In a manner not shown, instead or in addition, the underside of the sole base body 136 may be covered over its full surface with a fine textile overlay of this kind. The sole base body 136 and its layers as applicable are made from cork scrap, compressed with a binder, or a plastic form, or natural latex.

In FIG. 5, the top side of the upper layer 133 of the sole base body 136 is furthermore covered over its entire surface with a thin elastic intermediate layer 151, shown only in the form of a thicker line. The intermediate layer 151 thus covers the full surface, including the indentations 138, of the sole base body 136, so that indentations 152 corresponding to the indentations 138 are preserved in the intermediate layer 151. The intermediate layer 151 has a constant thickness, for instance of about 3 mm. Preferably, like the cushion-like layers 112 through 116, the intermediate layer 151 is made from a foam, such as foamed natural latex.

The cushion-like layers 112 through 115, which are for instance of the aforementioned foamed natural latex and have a thickness in the range between 4 and 5 mm and preferably 4.5 mm, for instance, are placed in the indentations 152 in the intermediate layer 151. By comparison, the cushion-like layer 116 for the plantar arch is disposed not in a indentation but directly on the intermediate layer 151, which in this region is flat or in other words is not provided with any indentation. At its thickest point, this cushion-like layer 116 is likewise approximately 4 to 5 mm thick, and preferably 4.5 mm thick, and it decreases steadily in thickness toward the inside of the sole 111. The flat top sides 156 of the plateau-like cushion-like layers 112 through 115 are thus raised by 1.5 to 2.5 mm, and preferably by about 2 mm, relative to the top side 157 of the intermediate layer 151. The top material, that is, the sole covering layer 137, covers the cushion-like layer 116 and also covers the cushion-like layers 112 through 115, in such a way that the latter layers, or their fields 118 through 127, are surrounded by indented edges and are solidly joined, preferably glued, to the intermediate layer 151, so that besides the boundary lines 128, 129 and 131, 132, intermediate boundary lines or regions 141 through 147 are also created that extend approximately perpendicular to the transversal direction of the insole 111.

Moreover, in the second cushion-like layer 113, the inner field 123 is drawn forward in a curve relative to the outer field 125 and the middle field 124. This region 163 that is drawn forward in a curve lengthens and widens the front surface of the field 123. As can be seen from FIG. 5, this region 163 drawn forward in a curve is not flat like the other surface regions of the cushion-like layer 113 but instead is arched upward as a dome, or in other words raised still further relative to the raised top side of the sole covering layer 137. This arch or dome 163 raises the level of the field 123 in this region compared to the fields 124 and 125 by approximately 2 mm and thus even more relative to the depressions 161 and 162.

In this exemplary embodiment as well, the depressions 161 and 162 are in longitudinally oriented alignment with the second and third fields 119 and 120, respectively, of the first cushion-like layer 112. Moreover, in this region they are located between the first cushion-like layer 112 and the second cushion-like layer 113, specifically essentially in the middle between them. Moreover, the location of the region that is drawn forward in a curve or in other words arched is such that its dome 163, in the longitudinally oriented direction of the shoe insole 11, is approximately in alignment with the transition area from one depression 161 to the other depression 162. In this way, this arched region 163 of the field 123, because of the additional elevation relative to the base of the depression 161, 162, brings about a further increase in the pressure relief of the two heads of the metatarsal bones affected. Also in this exemplary embodiment, the base of the depressions 161, 162 is located near the bottom of the sole base body 136, and the circular outline corresponds approximately to the anatomical outline of the head of the metatarsal bone in question. The outline of the dome 163 may be larger than the diameter of the depression 161, 162. In an embodiment not shown, adjacent, discrete circular depressions, such as 61 and 62 or 161 and 162, are united to form a single depression that is oval in plan view.

The invention claimed is:

1. A shoe insole for diabetics, having:

a sole base body;

a sole covering layer; and a plurality of cushion layers, provided over the sole surface, in the form of at least one first cushion layer in the forefoot joint area, a second cushion layer in the midfoot/tarsus transition area, and a third cushion layer in the midfoot/heel transition area, said cushion layers, serving to assist venous blood draining, are each individually divided into individual plateau areas, located adjacent one another, with the top side of said cushion layer, covered by said sole covering layer, and forms an approximate plane with the top side of sole base body or is raised relative to the plane of the top of said sole base body, wherein:

between said first cushion layer in the forefoot joint area and said second cushion layer in the midfoot/tarsus area, at least one depression is provided, serving to relieve the pressure on the head or heads of the metatarsal bone or bones and originating at the top of said sole base body.

2. The shoe insole of claim 1, wherein:

one depression is provided for the second had of the metatarsal bone, and/or one depression is provided for the third head of the metatarsal bone.

3. The shoe insole of claim 1, wherein:

one depression is provided for the first head of the metatarsal bone.

4. The shoe insole of claim 1, wherein:

one depression is provided for the fourth head of the metatarsal bone.

5. The shoe insole of claim 1, wherein:

the depression for the respective head of the metatarsal bone is located approximately in alignment with the respectively associated plateau area of the first cushion layer.

6. The shoe insole of claim 1, wherein:

said second cushion layer is provided with an inner field area, drawn forward in a curve toward said first cushion layer and arched so as to protrude relative to the raised top side of the said sole covering layer of the other areas or fields of said second cushion layer; and the drawn-forward inner field area protruding in dome fashion, is in alignment with the portions adjoining one another of the two depressions for said second and third heads of the metatarsal bones.

7. The shoe insole of claim 6, wherein:

the diameter of the drawn-forward and protruding inner field area is greater than the diameter of the depression for said second and for said third head of the metatarsal bone, respectively.

8. The shoe insole of claim 6, wherein:

the arching of the area drawn forward in a curve raises the level by approximately 2 mm.

9. The shoe insole of claim 1, wherein:

in the region of the heel, a fourth cushion layer is provided, which is plateau and preferably homogeneously oval in the transversal direction of the sole.

10. The shoe insole of claim 1, wherein:

in the region of the plantar arch, a fifth cushion layer is provided of crescent shape.

11. The shoe insole of claim 10, wherein:

said cushion layer are formed by a soft foam.

12. The shoe insole of claim 1, wherein:

the shoe insole is embodied as a replaceable separately inserted insole.

13. The shoe insole of claims 1, wherein:

the shoe insole is embodied as a sole that is integrated with a shoe.

* * * * *